United States Patent [19]

Berry

[11] Patent Number: 4,478,890

[45] Date of Patent: Oct. 23, 1984

[54] LOW TEMPERATURE DEPOSITION OF NICKEL FILMS

[75] Inventor: Alan D. Berry, Springfield, Va.

[73] Assignee: The United States of America as represented by the Secretary of the Navy, Washington, D.C.

[21] Appl. No.: 531,387

[22] Filed: Sep. 12, 1983

[51] Int. Cl.[3] ..... C23C 11/00; C23C 13/00; B05D 1/18

[52] U.S. Cl. ..... 427/252; 427/253; 427/255.1; 427/438

[58] Field of Search ..... 427/252, 253, 255.1, 427/438, 305, 306, 229

[56] References Cited

U.S. PATENT DOCUMENTS

| | | | |
|---|---|---|---|
| 3,438,805 | 4/1969 | Potrafke | 427/229 |
| 3,529,989 | 9/1970 | Jordan et al. | 427/314 |
| 3,619,288 | 11/1971 | Sirtl | 427/252 X |

*Primary Examiner*—Michael R. Lusignan

*Attorney, Agent, or Firm*—Robert F. Beers; William T. Ellis; Barry A. Edelberg

[57] ABSTRACT

A low-temperature, electroless process for the plating of nickel metal upon a substrate. Nickel, olefin, and trifluorophosphine vapors are condensed and reacted in a vessel. The reaction product is distilled off and condensed onto the surface of a substrate. The surface is warmed and the reaction product allowed to decompose, yielding a coating of nickel metal upon the substrate, gaseous olefin and $Ni(PF_3)_4$.

21 Claims, No Drawings

LOW TEMPERATURE DEPOSITION OF NICKEL FILMS

FIELD OF THE INVENTION

This invention relates generally to nickel plating and more specifically to electroless processes of nickel plating.

BACKGROUND OF THE INVENTION

In the past, several attempts have been made to develop an electroless process for plating nickel. Most of these electroless processes depended on the decomposition of some type of nickel compound or complex. For example, U.S. Pat. No. 3,529,989 to Jordan et al. refers to the plating of nickel by the thermal decomposition of a tetrakis(triorganophosphine) nickel (O). U.S. Pat. No. 3,619,288 to Sirtl refers to the plating of nickel by the thermal decomposition of a nickel trifluorophosphine complex. Unfortunately, the above-mentioned processes require temperatures in the 200°-600° C. range for decomposition to occur. While such temperatures are satisfactory for most applications, some applications require the coating of nickel on temperature sensitive substrates, such as optical fibers and plastics. Furthermore, the low temperature deposition of nickel may be a convenient method of making complex-shaped plastic surfaces conductive. Additionally, thin nickel films are useful catalysts in the production of synthetic fuels.

OBJECTS OF THE INVENTION

Accordingly, it is an object of this invention to produce a nickel coating upon a substrate at low temperatures employing an electroless process.

It is another object of this invention to produce a coating of nickel upon plastic or low melting substrates.

It is a further object of this invention to produce a conductive surface upon a non-conductive plastic.

SUMMARY OF THE INVENTION

These and other objects are achieved by forming a nickel-olefin-trifluorophosphine complex upon a substrate and then decomposing this complex to yield gaseous olefin, gaseous $Ni(PF_3)_4$ and a coating of nickel upon the substrate. This is typically done by condensing nickel and olefin vapors in a reaction vessel, warming the reaction vessel to allow the formation of a nickel-olefin compound, eliminating any unreacted olefin, condensing trifluorophosphine into the reaction vessel, reacting the trifluorophosphine with the nickel-olefin compound to form a reaction mixture comprising a nickel-olefin-trifluorophosphine complex, condensing this complex upon a substrate, then decomposing this complex upon the substrate to yield a coating of nickel metal, gaseous olefin, and gaseous $Ni(PF_3)_4$.

DESCRIPTION OF THE PREFERRED EMBODIMENTS

To coat nickel according to the present process of this invention, nickel and olefin vapors are typically condensed into a reaction vessel below −130° C. The vessel is warmed to about −120°--45° C. and most preferably between −120° and −90° C. to form a nickel-olefin compound and to drive off excess olefin. Trifluorophosphine vapor is then condensed into the vessel at below about −88° C. The vessel is then, if need be, warmed to about −120°--45° C., and most preferably between −120° and −90° C. to allow the formation of a nickel-olefin-trifluorophosphine complex.

Nickel vapor may be produced by any process used for that purpose. For example, nickel metal may be vaporized under a dynamic vacuum from a tungsten-/alumina crucible. Likewise, the olefin may be vaporized by any known means.

The nickel and olefin vapors may be condensed into the reaction vessel at any temperature below about −130° C. Preferably, these vapors are condensed at about −130°--200° C. Most preferably, for the sake of convenience, the vapors are condensed at liquid nitrogen temperatures, about −196° C.

While a variety of olefins may be used in the process of this invention, propene, trifluoropropene, vinyl fluoride and other closely related olefins are preferable. Typically, at least about a 10 fold mole excess of olefin relative to nickel is condensed into the reaction vessel in order to promote the complexation of as much nickel as possible. Similarly, at least about a 5 fold mole excess of trifluorophosphine in relation to nickel is condensed into the vessel for most favorable results.

Typically, reaction between the trifluorophosphine and the nickel-olefin compound occurs upon warming the reaction vessel to about −45°--120°, thus forming a complex. Preferably, the reaction vessel is warmed to about −120°--90° C. so that the reaction mixture remains in the liquid state.

The complex formed by the reaction of the nickel, trifluorophosphine and olefin distills in vacuo ($P<1$ torr) at about −63°--20° C. and most preferably at −45°--20° C. and may be removed from the reaction vessel and separated from impurities by fractional distillation. The vapors of this complex may be condensed for storage at low temperatures or condensed upon the substrate. Condensation of the complex is best carried out with the substrate at liquid nitrogen temperatures to promote transfer of the complex to the substrate.

After the complex has been condensed upon the substrate desired to be coated, the substrate is warmed to above about −20° C. so that the complex decomposes into a coating of nickel metal upon the substrate, gaseous olefin, and gaseous $Ni(PF_3)_4$. The nickel-olefin-trifluorophosphine complexes decompose at between about −20° and 6° C. The olefin and $Ni(PF_3)_4$, being gaseous, are driven off.

The condensation of nickel and olefin must be carried out in vacuo. The condensation of trifluorophosphine may be carried out in vacuo or in an inert atmosphere. However, in an inert atmosphere, the trifluorophosphine must be bubbled into the reaction vessel. The other steps of this process may also be carried out in vacuo or in an inert atmosphere but are preferably carried out in vacuo. It is believed that the reactions in this process occur quite rapidly at the temperatures indicated. It is also believed that visible and/or U.V. light may assist in the breakdown of the nickel-olefin-trifluorophosphine complex, although such light is not necessary for decomposition to occur.

The coatings formed by this process have been found to adhere well to the substrates upon which they are formed. Almost any substrate, including plastic and glass, should be a suitable substrate upon which nickel may be plated.

The depth of the coating formed is dependant upon the the amount of complex condensed upon the substrate. Clearly, the greater the amount of complex condensed on the substrate to be plated, the thicker the nickel coating that will be formed.

EXAMPLES

Having described the invention in general, the following examples are being given to illustrate the principles of the invention and are not intended to limit the scope of the invention in any manner.

The metal-atom vapor apparatus was similar to that commonly used and known. Vacuum system manipulations were carried out in a Pyrex TM system with greaseless Kontes TM glass/Teflon TM valves. Routine infrared spectra were recorded on a Perkin-Elmer 457 TM spectrometer using a 5 cm glass cell with KBr windows. Attempts to obtain infrared spectra of isolable, but thermally unstable, products were made by using a Digilab FTS-15C TM Fourier transform interferometer. NMR spectra were recorded on a Varian EM-390 TM spectrometer operating at 90 MHz for proton and 84.68 MHz for fluorine nuclei and equipped with an EM-3940 TM variable-temperature accessory calibrated with a methanol sample.

Propene, vinyl chloride, and vinyl fluoride were obtained from Matheson Gas Products and used as received. Trifluoropropene, was purchased from PCR and used without further purification. Trifluorophosphine was obtained from Ozark-Mahoning and purified by vacuum distillation through a −160° C. trap. The reaction of nickel vapor with $FCH{=}CH_2$ and $PF_3$ described herein was representative of those reactions involving other olefins. Nickel metal (2.79 mmol) was vaporized and codeposited with $FCH{=}CH_2$ (41.53 mmol) at liquid-nitrogen temperatures during 1.5 h. The reactor was closed off and the dark brown matrix warmed slightly until it melted producing streaks of brown liquid that collected at the bottom of the reactor. A toluene slush bath at −96° C. was placed around the reactor for 0.5 h before the reactor was opened to a trap cooled to −196° C. and the volatile materials collected during a 1 h period ($FCH{=}CH_2$, 35.38 mmol). The reactor was again cooled to −196° C. and $PF_3$ (18.34 mmol) added. After this mixture was allowed to stand for 0.5 h at −96° C., materials that were volatile at this temperature were collected in a separate trap. The toluene slush was removed and the reactor warmed gradually to ambient temperatures as additional volatile materials were collected at −196° C.

The materials obtained from the reactor at −96° C. after $PF_3$ was added were separated by fractional condensation through traps at −160° and −196° C. The −196° C. fraction was identified as $PF_3$ (14.13 mmol) and that at −160° as $FCH{=}CH_2$ (2.89 mmol).

A chlorobenzene slush bath at −45° was placed around the trap containing volatile materials collected on warming the reactor from −96° C. to ambient, and the more volatile components were transferred to another trap at −196° C. Separation of this latter material by fractional condensation using traps at −96° C. and −196° C. produced $FCH{=}CH_2$ (2.85 mmol) and $Ni(PF_3)_4$ (0.69 mmol). The $Ni(PF_3)_4$ was identifited by gas-phase molecular weight measurements (407.7 vs. 410.6 calcd) and its infrared spectrum.

The clear yellow liquid (106.1 mg) remaining in the trap at −45° C. was transferred in vacuo to a tared vessel at −196° C. and warmed to ambient conditions. Within 1-2 min, a black deposit and fine black particles were visible. This was followed by the slow formation of a reflective metallic coating over the walls of the vessel. After being left at ambient conditions for nine days, the volatile materials were transferred to the vacuum system and separated by fractional condensation using traps at −96° and −196° C. to yield $FCH{=}CH_2$ (−196° C., 0.27 mmol) and $Ni(PF_3)_4$ (−96° C., 0.22 mmol); the weight of a tared vessel increased by 2.4 mg. The molecular stoichiometry determined from the decomposition products was $Ni_{1.0}(PF_3)_{3.4}(C_2H_3F)_{1.0}$, which corresponded to a 10.3% yield based on the amount of nickel metal evaporated.

Trifluorophosphine was chosen as the trapping ligand in these systems primarily for two reasons. First, being a good $\pi$ acceptor and a rather weak $\sigma$ donor, it would be expected to impart some degree of stability to the metal-olefin bond without displacing the olefin from the nickel entirely. Second, because of the high volatility of $PF_3$, it was likely that any product containing it would also be volatile; this would facilitate handling if the product proved to be unstable.

The effect of adding $PF_3$ to the preformed nickel-olefin compound −96° C. was to displace some, but not all of the olefin. Yields based on the amount of nickel evaporated ranged from 10 to 38% and, as often happens in metal-vapor reactions, appeared to be dependent on the rate of evaporation of the nickel. In general, the molar quantities of $PF_3$ consumed were substantially more than the olefin displaced, with most values of the $PF_3$:olefin ratio falling between 1.75 and 1.45. The experimental data suggested the formation of an original tris(olefin) compound that was converted to an 18-electron complex upon reacting with $PF_3$. Presumably, the olefin remained bonded to the nickel, making it effectively four-coordinate, although this was not confirmed by infrared spectra due to the low thermal stabilities as indicated below.

In the reaction of $PF_3$ with the nickel-vinyl chloride compound, the products collected on warming the reactor from −96° C. to ambient included $Ni(PF_3)_4$, $C_2H_3Cl$, $PF_3$, and a small amount of brown residues. The absence of a nickel mirror that was observed in reactions with other olefins suggested that no nickel-olefin-$PF_3$ material had transferred from the reactor.

For the reactions with vinyl fluoride, trifluoropropene, and propene, liquid products were collected at liquid-nitrogen temperatures on warming the reactor from −96° C. to ambient. The trifluoropropene complex collected just above the liquid-nitrogen level in an orange ring which formed a yellow liquid upon melting. The propene complex also gave a yellow liquid upon melting. All of these materials decomposed as they were warmed to ambient temperatures to yield nickel metal, primarily as uncharacterized films, $Ni(PF_3)_4$, and olefin. In at least the propene and trifluoropropene complexes, the decomposition was not complete and gave indications of being photoassisted. The ratio of olefin to $Ni(PF_3)_4$ recovered in this decomposition was 1.2:1.0. These results are consistent with the formation of a tris(trifluorophosphine)nickel-olefin complex.

Obviously, many modifications and variations are possible in light of the above teachings. It is therefore to be understood that, within the scope of the appended claims, the invention may be practiced otherwise than as specifically described.

What is claimed and desired to be secured by Letters Patent of the United States:

1. A low temperature process for the deposition of nickel upon a substrate, the steps of which comprise:

forming a nickel-olefin-trifluorophosphine complex;

collecting said complex as a condensate upon said substrate;

decomposing said complex upon said substrate to form an olefin, a coating of nickel metal, and $Ni(PF_3)_4$.

2. The process of claim 1 wherein said forming step comprises the steps of:

condensing nickel and olefin vapors on the wall of a vessel;

reacting said nickel and olefin to form a nickel-olefin compound;

eliminating any unreacted olefin from said vessel;

condensing trifluorophosphine into said vessel;

reacting said trifluorophosphine with said nickel-olefin compound to form a reaction mixture comprising a nickel-olefin-trifluorophosphine complex.

3. The process of claim 2 further comprisng the step of selecting said olefin from the group comprising propene, trifluoropropene and vinyl fluoride.

4. The process of claim 3 wherein said nickel and olefin vapors are condensed in vacuo on the walls of said vessel.

5. The process of claim 4 wherein an at least about 10 fold mole excess of said olefin relative to said nickel is condensed into said vessel.

6. The process of claim 5 wherein an at least about 5 fold mole excess of said trifluorophosphine relative to said nickel is condensed into said vessel.

7. The process of claim 6 wherein said olefin and nickel vapors are condensed onto the walls of said vessel at below about −130° C.

8. The process of claim 6 wherein said olefin and nickel vapors are condensed at about −130°−−200° C.

9. The process of claim 6 wherein said nickel and olefin reacting step comprises the step of reacting said nickel and olefin at about −120°−−45° C.

10. The process of claim 9 wherein said nickel-olefin compound and trifluorophosphine reacting steps comprise reacting said nickel olefin compound and trifluorophosphine at −120°−−45° C.

11. The process of claim 10 wherein said eliminating step comprises the step of warming the contents of said vessel to about −120°−−45° C.

12. The process of claim 11 wherein said collecting step comprises the step of warming the contents of said vessel to about −63°−−20° C., whereby vapors are formed, and condensing upon said substrate the vapor fraction formed while said vessel contents are at −45°−−20° C.

13. The process of claim 2 further comprising the step of selecting said olefin to consist essentially of propene.

14. The process of claim 13 wherein said nickel and olefin vapors are condensed in vacuo on the walls of said vessel.

15. The process of claim 14 wherein an at least about 10 fold mole excess of said olefin relative to said nickel is condensed into said vessel.

16. The process of claim 15 wherein an at least about 5 fold mole excess of said trifluorophosphine relative to said nickel is condensed into said vessel.

17. The process of claim 2 further comprising the step of selecting said olefin to consist essentially of trifluoropropene.

18. The process of claim 17 wherein said nickel and olefin vapors are condensed in vacuo on the walls of said vessel.

19. The process of claim 18 wherein an at least about 10 fold mole excess of said olefin relative to said nickel is condensed onto said vessel.

20. A low temperature process for the deposition of nickel upon a substrate, the steps of which comprise:

condensing nickel and propene vapors in vacuo on the walls of a vessel in about a 10:1 molar ratio of propene to nickel;

reacting at about −120°−−145° C. said nickel and propene to form a nickel-propene compound;

eliminating any unreacted propene from said vessel:

condensing trifluorophosphine into said vessel;

reacting said trifluorophosphine with said nickel-propene compound at about −120°−−45° C. to form a reaction mixture comprising a nickel-propene-trifluorophosphine complex;

collecting said complex as a condensate upon said substrate;

decomposing said complex upon said substrate to form propene, a coating of nicke metal, and $Ni(PF_3)_4$;

removing said propene and $Ni(PF_3)_4$.

21. A low temperature process for the deposition of nickel upon a substrate, the steps of which comprise:

condensing nickel and trifluoropropene vapors in vacuo on the walls of a vessel in about a 10:1 molar ratio of trifluoropropene to nickel;

reacting at about −120°−−145° C. said nickel and trifluoropropene to form a nickel-trifluoropropene compound;

eliminating any unreacted trifluoropropene from said vessel;

condensing trifluorophosphine into said vessel;

reacting said trifluorophosphine with said nickel-trifluoropropene compound at about −120°−−45° C. to form a reaction mixture comprising a nickel-trifluoropropene-trifluorophosphine complex;

collecting said complex as a condensate upon said substrate;

decompsoing said complex upon said substrate to form trifluoropropene, a coating of nickel metal, and $Ni(PF_3)_4$;

removing said trifluoropropene and $Ni(PF_3)_4$.

* * * * *